US010918218B1

(12) United States Patent
Pieroth

(10) Patent No.: US 10,918,218 B1
(45) Date of Patent: Feb. 16, 2021

(54) UNDER BED GUN HOLSTER HOLDER

(71) Applicant: Robert F. Pieroth, Glendora, CA (US)

(72) Inventor: Robert F. Pieroth, Glendora, CA (US)

( * ) Notice: Subject to any disclaimer, the term of this patent is extended or adjusted under 35 U.S.C. 154(b) by 159 days.

(21) Appl. No.: 15/895,906

(22) Filed: Feb. 13, 2018

(51) Int. Cl.
*A47C 21/00* (2006.01)
*F41C 33/04* (2006.01)

(52) U.S. Cl.
CPC ..... *A47C 21/00* (2013.01); *F41C 33/041* (2013.01)

(58) Field of Classification Search
CPC ..... F41C 33/041; A47C 21/00
See application file for complete search history.

(56) References Cited

U.S. PATENT DOCUMENTS 5,732,914 A * 3/1998 Flinn ..... A47C 21/00 211/64
5,848,834 A 12/1998 Kerr
6,206,543 B1 * 3/2001 Henry ..... A45F 5/02 362/103
D455,065 S 4/2002 Berg
6,409,131 B1 6/2002 Bentley et al.
6,854,139 B2 2/2005 Lamy
7,641,356 B2 * 1/2010 Pieroth ..... F21L 15/10 248/214
8,177,065 B1 * 5/2012 Thomas ..... A47C 19/22 206/376
2005/0242251 A1 * 11/2005 Licht ..... F41C 33/041 248/205.1
2011/0155775 A1 * 6/2011 Craighead ..... F41C 33/041 224/243
2013/0306693 A1 * 11/2013 Prestwich ..... A45F 5/00 224/269

* cited by examiner

*Primary Examiner* — David R Hare
*Assistant Examiner* — Adam C Ortiz
(74) *Attorney, Agent, or Firm* — Myers Andras LLP; Joseph C. Andras

(57) ABSTRACT

An under bed gun holster holder for supporting a gun placed in a gun holster beneath a bed for ready access is disclosed. The holder includes a top portion for connection to a bed frame, a middle section, and an attachment section configured to releasable attach to the gun holster. The top portion may attach to the bed frame without fastener, for example, by sliding over the vertical side wall of the bed frame. The middle section may extend downward and underneath the bed, such that the attachment section enables the gun to be positioned beneath the bed and recessed from the edges of the bed and is hidden from view with a bed skirt.

18 Claims, 5 Drawing Sheets

UNDER BED GUN HOLSTER HOLDER

BACKGROUND OF THE INVENTION

1. Field of the Invention

The present invention relates in general to gun holsters, and more particularly, to a under bed gun holster holder.

2. Description of the Related Art

Many gun owners want their guns accessible at all times, especially when they are most vulnerable, such as at nighttime, while sleeping in bed. Storing a gun in a night stand may be problematic as the gun may be covered with other items. Gun safes which can be rapidly opened by pressing a few buttons offer one potential solution, but a gun owner would be potentially delayed in responding to a threat attempting to locate the safe in the dark.

Accordingly, a need exists to provide under bed gun holster holders which provide swift, ready access for gun owners during a threat.

SUMMARY OF THE INVENTION

In the first aspect, a gun holster holder for securing a gun holster beneath a bed frame is disclosed. The gun holster holder comprises a top portion configured to attach to a bed frame, a vertical section emerging downward from the top portion and extending beneath the bed frame, and a horizontal section emerging perpendicular to the vertical section and extending to beneath the bed frame. The gun holster holder further comprises a U-shaped section emerging from the horizontal section, and a gun holster attachment section emerging from the U-shaped section, the gun holster attachment section configured to secure a gun holster.

In a first preferred embodiment, the top portion comprises an inverted U-shaped bend configured to couple with an L-shaped bed rail with a vertical wall and a horizontal support, the U-shaped bend configured to slip over the vertical wall of the bed rail. The gun holster holder is preferably configured to position a gun holster laterally such that a gun placed in the gun holster is underneath the bed frame and is recessed from the edge of the bed frame. The gun holster attachment section preferably comprises a gun holster clip engagement section configured to receive and releasably secure a clip from the gun holster. The portion of the gun holster clip engagement section proximal to the U-shaped section preferably has a first thickness, and the portion of the gun holster clip engagement section distal from the U-shaped section preferably has a second thickness, wherein the second thickness is preferably greater than the first thickness. The gun holster clip engagement section preferably further comprises a sloped section transitioning between the distal and the proximal sections of the gun holster section.

The gun holster clip engagement section preferably comprises a slot running perpendicular to the length of the gun holster engagement section. The gun holster clip engagement section preferably comprises a V-shaped notch formed in a mounting portion, the mounting portion having a generally constant thickness. The gun holster clip engagement section preferably comprises a mounting portion having a boss protrusion for engaging with the clip of a gun holster, the notch surrounded by one or more ridges configured to secure a holster clip. The gun holster holder is preferably formed in a single piece of material.

In a second aspect, a gun holster holder for securing a gun holster beneath a bed frame is disclosed. The gun holster holder comprises a top portion configured to attach to the bed frame, a middle section extending downward from the top portion and extending beneath the bed frame and extending inward away from an edge of the bed frame, and a gun holster attachment section emerging from the middle section, the gun holster attachment section configured to receive and releasably secure the gun holster.

In a second preferred embodiment, the top portion comprises an inverted U-shaped bend configured to couple with an L-shaped bed rail with a vertical wall and a horizontal support, the U-shaped bend configured to slip over the vertical wall of the bed rail. The gun holster holder is preferably configured to position a gun holster laterally such that a gun placed in the gun holster is underneath the bed frame and is recessed from the edge of the bed frame. The gun holster attachment section preferably comprises a gun holster clip engagement section configured to receive and releasably secure a clip from the gun holster. The portion of the gun holster clip engagement section proximal to the U-shaped section preferably has a first thickness, and the portion of the gun holster clip engagement section distal from the U-shaped section preferably has a second thickness, wherein the second thickness is preferably greater than the first thickness. The gun holster clip engagement section preferably further comprises a sloped section transitioning between the distal and the proximal sections of the gun holster section.

The gun holster clip engagement section preferably comprises a slot running perpendicular to the length of the gun holster engagement section. The gun holster clip engagement section preferably comprises a V-shaped notch formed in a mounting portion, the mounting portion having a generally constant thickness. The gun holster clip engagement section preferably comprises a mounting portion having a boss protrusion for engaging with the clip of a gun holster, the notch surrounded by one or more ridges configured to secure a holster clip. The gun holster holder is preferably formed in a single piece of material.

In a third aspect, a method of securing a gun holster beneath a bed frame with a hook member that has a top retention portion and a lower portion configured for attaching to a gun holster, the bed frame formed from an L-shaped rail with a vertical wall and a horizontal wall is disclosed. The method comprises the steps of providing an inverted U-shaped bend in the top retention portion of the hook member, attaching the inverted U-shaped bend in the top retention portion of the hook member to the vertical wall of the L-shaped rail of the bed frame, providing a middle portion extending below and extending backward away from the top portion to beneath the bed frame, and securing a gun holster in the lower portion configured for attaching to a gun holster, the lower portion supports the gun holster below the bed frame and substantially flush with a side of the bed frame.

These and other features and advantages of the invention will become more apparent with a description of preferred embodiments in reference to the associated drawings.

DETAILED DESCRIPTION OF THE PREFERRED EMBODIMENTS

Handgun ownership has increased over the last several decades. Often, gun owners rely on handguns for self-defense in their homes. When faced with a present threat, gun owners require immediate access to their weapons. During daylight hours, quick-access gun safes may be employed where gun owners may readily access their handguns by entering simple numeric codes into a keypad. However, accessing a handgun in response to an immediate threat while in bed, particularly if the room is darkened, is problematic. Embodiments described herein offer a means to discretely store a home protection gun, at the ready, at night, where the gun may be more securely stored in a gun safe during the day.

Teachings relating to the below bed holders disclosed in U.S. patent application Ser. No. 11/633,825 filed Dec. 5, 2006 entitled "BEDSIDE FLASHLIGHT CRADLE" which issued as U.S. Pat. No. 7,641,356 on Jan. 5, 2010 may be employed herein and the disclosure of which is incorporated herein by reference in its entirety.

Figure 1:
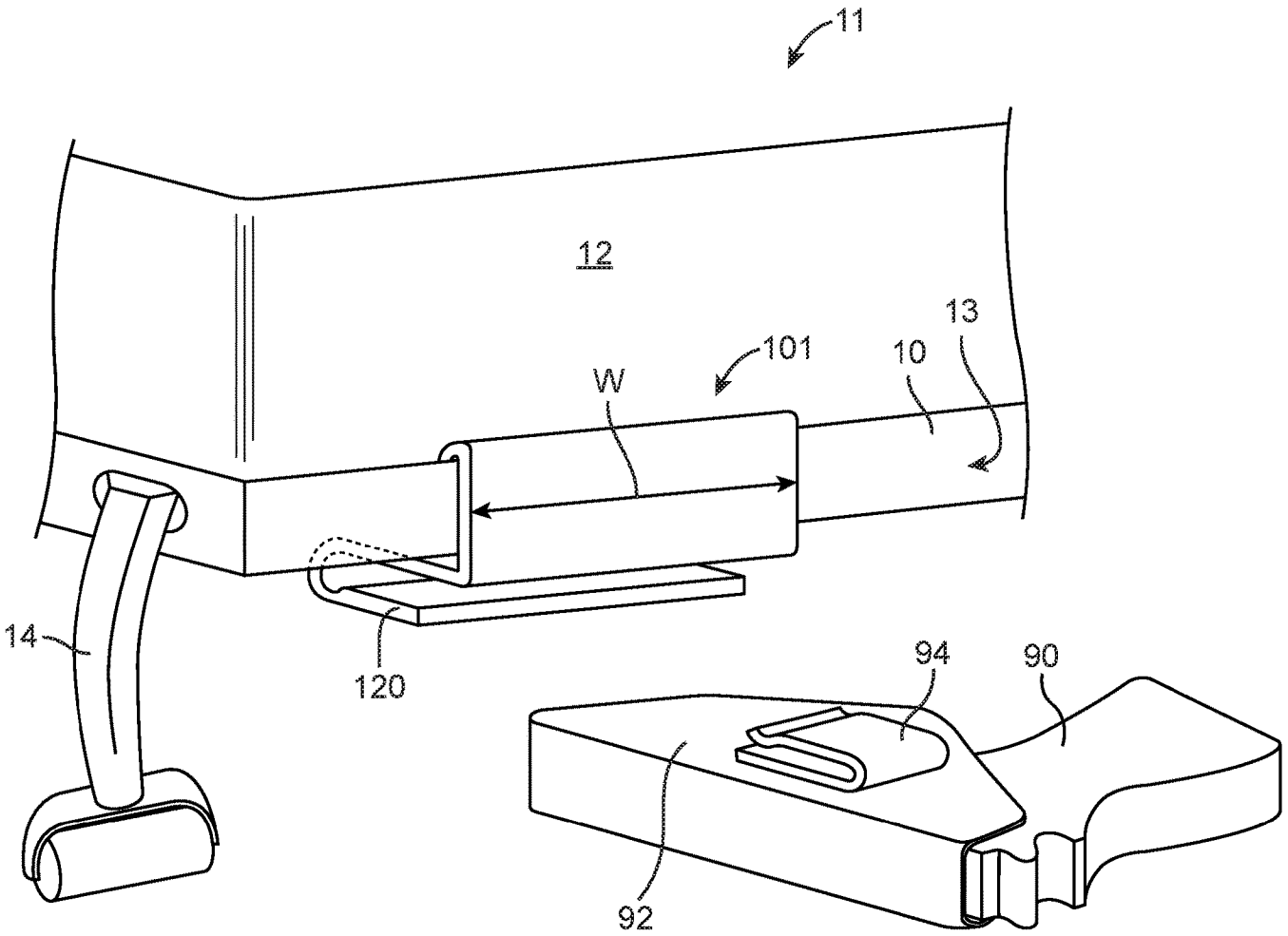
FIG. 1 is a perspective view of a gun placed in a holster being attached to a gun holster holder under a bed.

FIG. 1 is a perspective view of a gun 90 placed in a gun holster 92 being attached to a gun holster holder 101 by the side of a bed 11 in an embodiment. A bed 11 typically comprises a mattress (not shown) placed on top of a box spring 12. The box spring 12 is lifted above a floor by a bed frame 13 having a plurality of bed legs 14. A bed frame may comprise an "L-shaped" bed frame rail 10 having a vertical wall 15 and a horizontal platform 17.

In an embodiment, a gun holster holder 101 may facilitate the quick retrieval of a gun 90 when the gun owner is in bed. The gun 90 is placed in a gun holster 92. A gun owner may select a right-handed holster if the owner is sleeping on the right side of the bed, or a left-handed holster if the owner is sleeping on the left side of the bed. A gun holster 92 typically has a gun holster clip 94 which may be used to attach the gun holster 92 to a belt of a user. The gun holster holder 101 is configured to be attached to the bed frame 13, and is shaped to provide a gun holster attachment section 120 beneath the bed 11 and recessed from the edge of the bed. The gun holster attachment section 120 is configured to releasably attach to the gun holster clip 94.

Should a threat arise while a user is in bed, the user may reach down below the bed frame 13 and quickly retrieve the gun 90. The gun holster holder 101 positively secures the gun holster 92 when the user removes the gun 90. Embodiments enable the gun 90 to be out of sight under the bed 11, where the gun 90 is laterally displaced backward toward the center of the bed 11 and away from a bed skirt. In other words, the gun holster holder 101 is configured to laterally position a gun holster 92 such that a gun 90 placed in the gun holster 92 is completely underneath the bed frame 13 and is recessed from the edge of the bed frame 16 and is hidden from view with a bed skirt.

In one or more embodiments, the gun holster holder 101 may be fabricated employing an extrusion process. The gun holster holder 101 may be formed from any suitable material, including, but not limited to, plastic (e.g. PVC ("Polyvinyl Chloride"), ABS ("Acrylonitrile-Butadiene-Styrene") plastic or thermoplastics) or metal (e.g. steel or aluminum). In one or more embodiments, the extruded components may be further subjected to post-extrusion processes such as milling or drilling.

In an embodiment, the gun holster holder 101 preferably has a width (illustrated as "W" in FIG. 1) of approximately four inches that would create a stout support, but other widths are contemplated. The gun holster holder 101 must support the weight of the gun 90 and gun holster 92, and should be designed to inhibit the holster 92 from twisting on the mount (i.e., the bed frame 13) when the user inserts or removes the gun 90. The thickness of the gun holster holder 101 may be approximately ⅛", and may be determined based on material cost and required stoutness.

Figure 2:
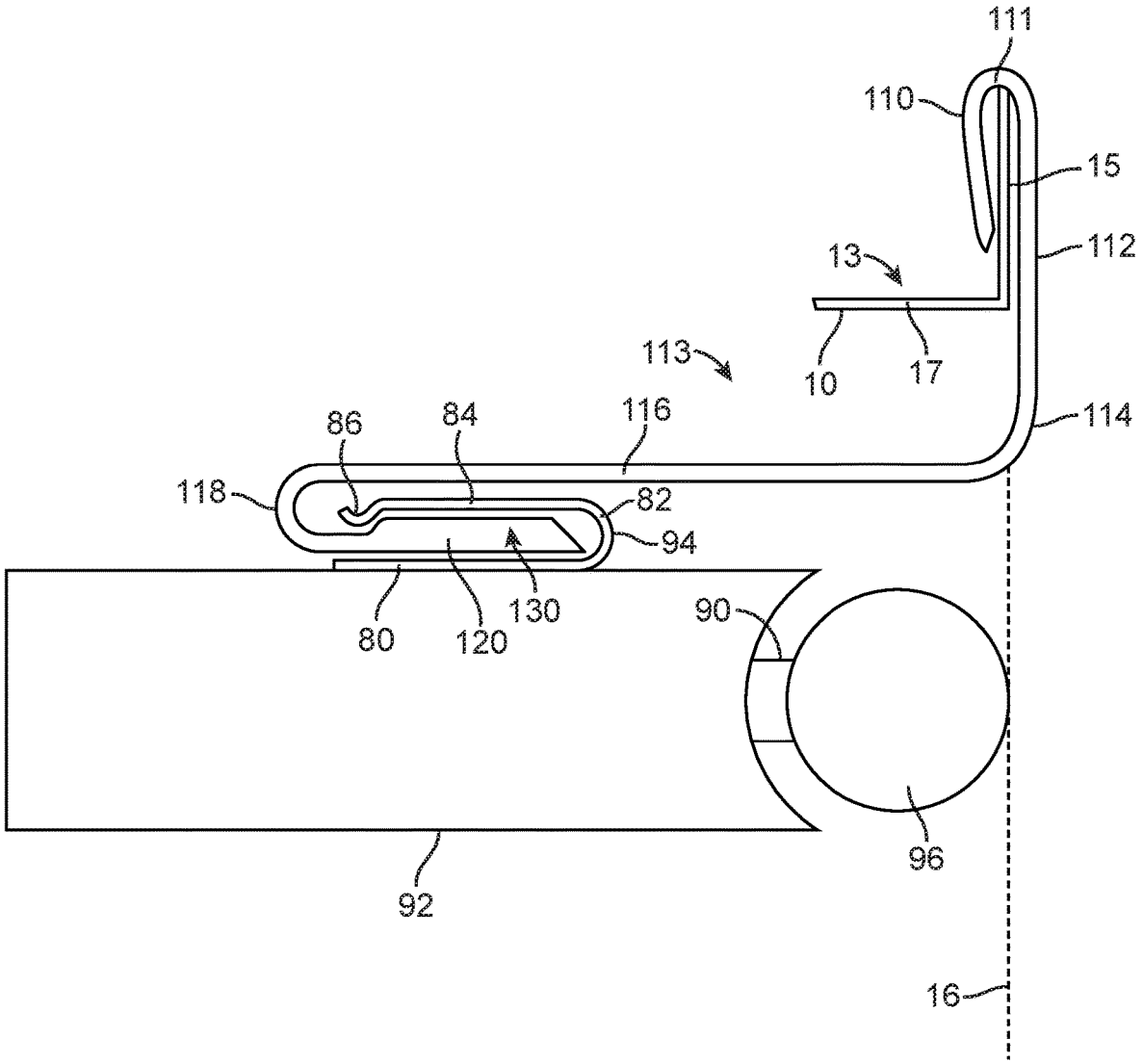
FIG. 2 is a cross-sectional view of a gun placed in a holster being attached to a gun holster holder under a bed.

FIG. 2 is a cross-sectional view of a gun 90 placed in a gun holster 92 being attached to a gun holster holder 101 by the side of a bed 11. In an embodiment, the gun holster holder 101 comprises a top portion 110 configured to attach to the bed frame 13, a vertical section 112 emerging downward from the top portion 110 and toward beneath the bed frame 13, a horizontal section 116 emerging perpendicular via the 90 degree bend 114 with respect to the vertical section 112 and directed to beneath the bed frame 13, a U-shaped section 118 emerging from the horizontal section 116, and a gun holster attachment section 120 emerging from the U-shaped section, where the gun holster attachment section 120 is configured to receive and releasably secure the gun holster 92.

Other designs are contemplated in one or more embodiments. In an embodiment, the gun holster holder 101 comprises a top portion 110 configured to attach to the bed frame 13, a middle section 113 extending downward from the top portion 110 and extending beneath the bed frame 13 and extending inward away from an edge of the bed frame 16, and a gun holster attachment section 120 emerging from the middle section, the gun holster attachment section configured to receive and releasably secure the gun holster. While the middle section 13 depicted in FIG. 2 may employ a vertical section 112, a bend 114, a horizontal section 116, and a U-shaped section 118, other shapes for connecting the top portion 110 to the gun holster attachment section 120 are contemplated in one or more embodiments.

In a preferred embodiment, the top portion 110 comprises an inverted U-shaped bend 111 configured to mount on a bed frame rail 10 without tools or sheet metal screws. In particular, a top portion 110 of the first preferred gun holster holder 101 includes a fastener-free means for grasping the bed frame 13. Here, as best shown in FIG. 2, the inverted U-shaped bend 111 slips over the vertical wall 15 of the L-shaped rail 10 of the bed frame 13.

One convenient way of attaching a gun holster 92 to a gun holster holder 101 may be to couple the gun holster clip 94 to the holder 101. Many commercially-available gun holsters 92 have a holster clip 94 that enables a user to attach a gun holster 92 to a belt or clothing. As shown in FIG. 2, a holster clip 94 may have a clip back section 80 which is permanently affixed to the gun holster 92. A 180 degree bend 82 emerges from the clip back 80, to which a clip top 84 emerges. Many holster clips 94 also have a V-shaped notched formed in the clip top 84. As a user attaches a holster clip 94 to an article of clothing, for example, the clip top 84 secures the clip 94 to the clothing via compression as well as through the use of the V-shaped notch 86.

In one or more embodiments, the gun holster attachment section 120 comprises a gun holster clip engagement section 130 configured to receive and releasably secure a clip 94 from the gun holster 92. While many of the embodiments described herein employ a holster clip engagement section 130 to secure a clip 94 mounted on a holster 94, other means of attaching a gun holster 92 to the gun holster holder 101, either temporarily or permanently, such as by employing a belt, strap, or other means of securing a gun holster 92 are contemplated in one or more embodiments.

Figure 3:
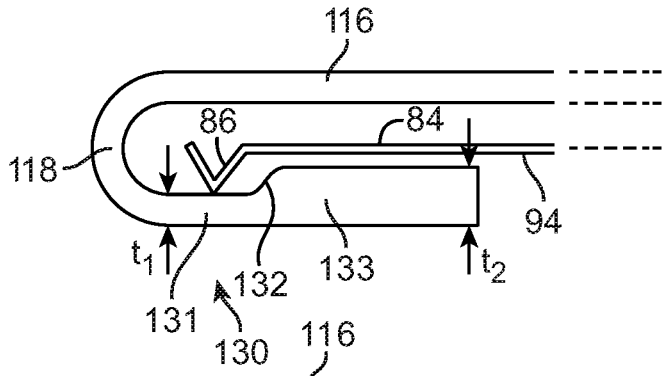
FIG. 3 is a cross-sectional view of a gun holder clip engagement section having a contour to receive a clip of a gun holster in an embodiment.

FIG. 3 is a cross-sectional view of a gun holder clip engagement section 130 having a contour to receive a clip 94 of a gun holster 92 in an embodiment. In one or more embodiments, a portion of the gun holster clip engagement section proximal to the U-shaped section 130 has a first thickness (depicted as "$t_1$"), and the portion of the gun holster clip engagement section distal from the U-shaped section 133 has a second thickness (depicted as "$t_2$"), where in the second thickness is greater than the first thickness (i.e., $t_2>t_1$). When attached, the clip top 84 of the holster clip 94 applies a downward force onto the portion of the gun holster clip engagement section distal from the U-shaped section 133 which secures the gun holster 92 to the holster holder 101. The thickness of the portion of the gun holster clip engagement section distal from the U-shaped section 133 may be tailored to accommodate clips 94 from different brands and models of gun holsters 92.

In an embodiment, the gun holster clip engagement section 130 further comprises a sloped section 132 transitioning between the distal 133 and the proximal 131 sections of the gun holster clip engagement section 130. As depicted in FIG. 3, the clip notch 86 of the clip 94 applies a lateral force to the sloped section 132 which further secures the gun holster 92 to the holster holder 101.

Figure 4:
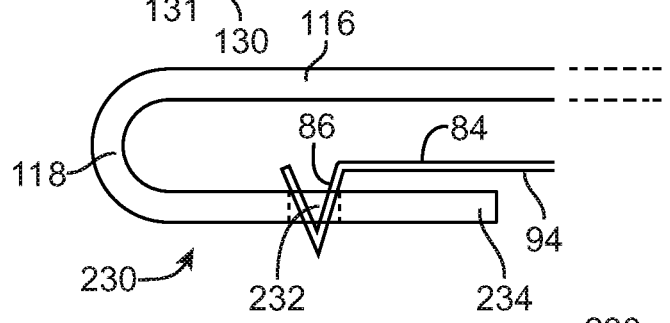
FIGS. 4 and 5 are a cross-section view and a top view respectively of a gun holder clip engagement section employing a slot to receive a clip of a gun holster in an embodiment.
Figure 5:
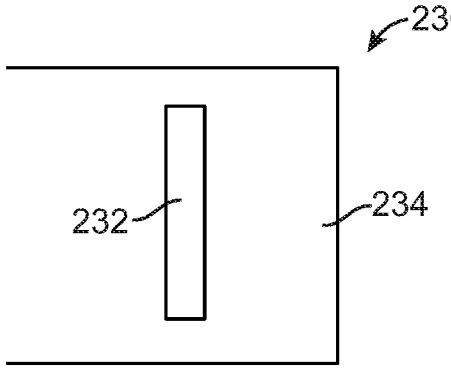

FIGS. 4 and 5 are a cross-sectional view and a top view respectively of a gun holder clip engagement section 230 employing a slot 232 to receive a clip 94 of a gun holster 92 in an embodiment. The clip engagement section 230 may comprise a mounting portion 234 having a generally constant thickness, or may comprise a mounting portion 234 with varying thickness. In one or more embodiments, the gun holster clip engagement section 230 comprises a slot 232 running perpendicular to the length of the mounting portion 234. When attached, the clip notch 86 of the holster clip 94 becomes seated within the slot 232 which secures the gun holster 92 to the holster holder 101.

Figure 6:
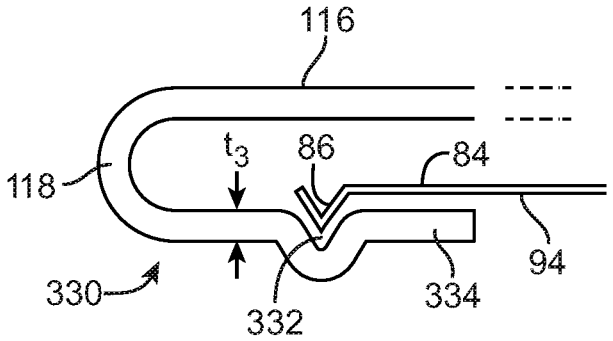
FIG. 6 is a cross-sectional view of a gun holder clip engagement section having a V-shaped notch to receive a clip of a gun holster in an embodiment.

FIG. 6 is a cross-sectional view of a gun holder clip engagement section 330 having a V-shaped notch 332 to receive a clip 94 of a gun holster in an embodiment. The clip engagement section 330 may comprise a mounting portion 334 having a generally constant thickness (depicted as "t3"), or may comprise a mounting portion 334 with varying thickness. In one or more embodiments, the gun holster clip engagement section 330 comprises a V-shaped notch 332. When attached, the clip notch 86 of the holster clip 94 becomes seated within the notch 332 which secures the gun holster 92 to the holster holder 101.

Figure 7:
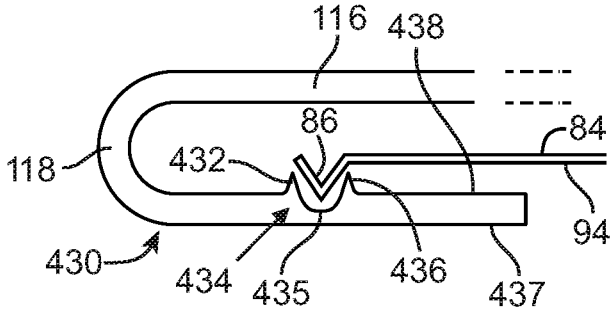
FIG. 7 is a cross-sectional view of a gun holder clip engagement section having a boss protrusion to receive a clip of a gun holster in an embodiment.

FIG. 7 is a cross-sectional view of a gun holder clip engagement section 430 having a boss protrusion 434 to receive a clip 94 of a gun holster 92 in an embodiment. In one or more embodiments, the boss protrusion 434 comprises a notch 435 surrounded by ridges 432 and 436. When attached, the clip notch 86 of the holster clip 94 becomes seated within the boss protrusion 434 and secured by ridges 432 and 436 which attaches the gun holster 92 to the holster holder 101. In an embodiment, the bottom surface 437 is generally flat and the top surface 438 is contoured to form the notch 435 and the ridges 432 and 436.

Figure 8:
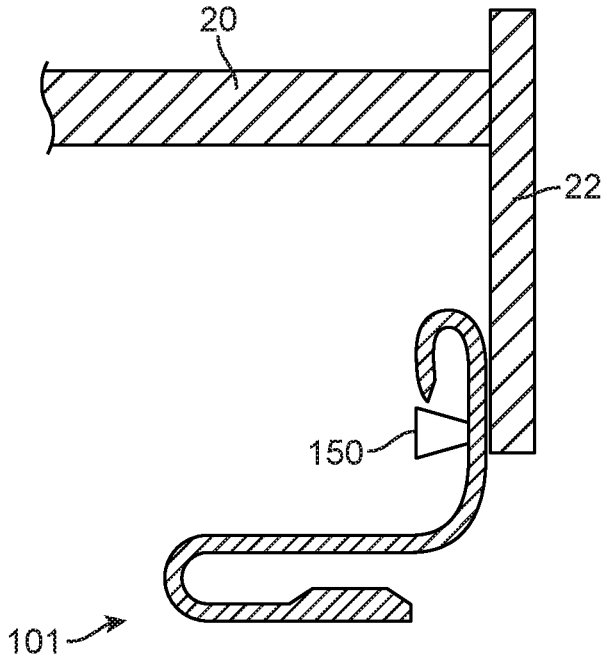
FIG. 8 is a cross-sectional view of a gun holster holder attached to a wooden bed frame in an embodiment.

FIG. 8 is a cross-sectional view of a gun holster holder 101 attached to a wooden bed frame in an embodiment. The wooden bed frame comprises a rail 20 and a vertical side 22. In an embodiment, a screw 150 may be employed to attaching the gun holster holder 101 to a bed.

Figure 9:
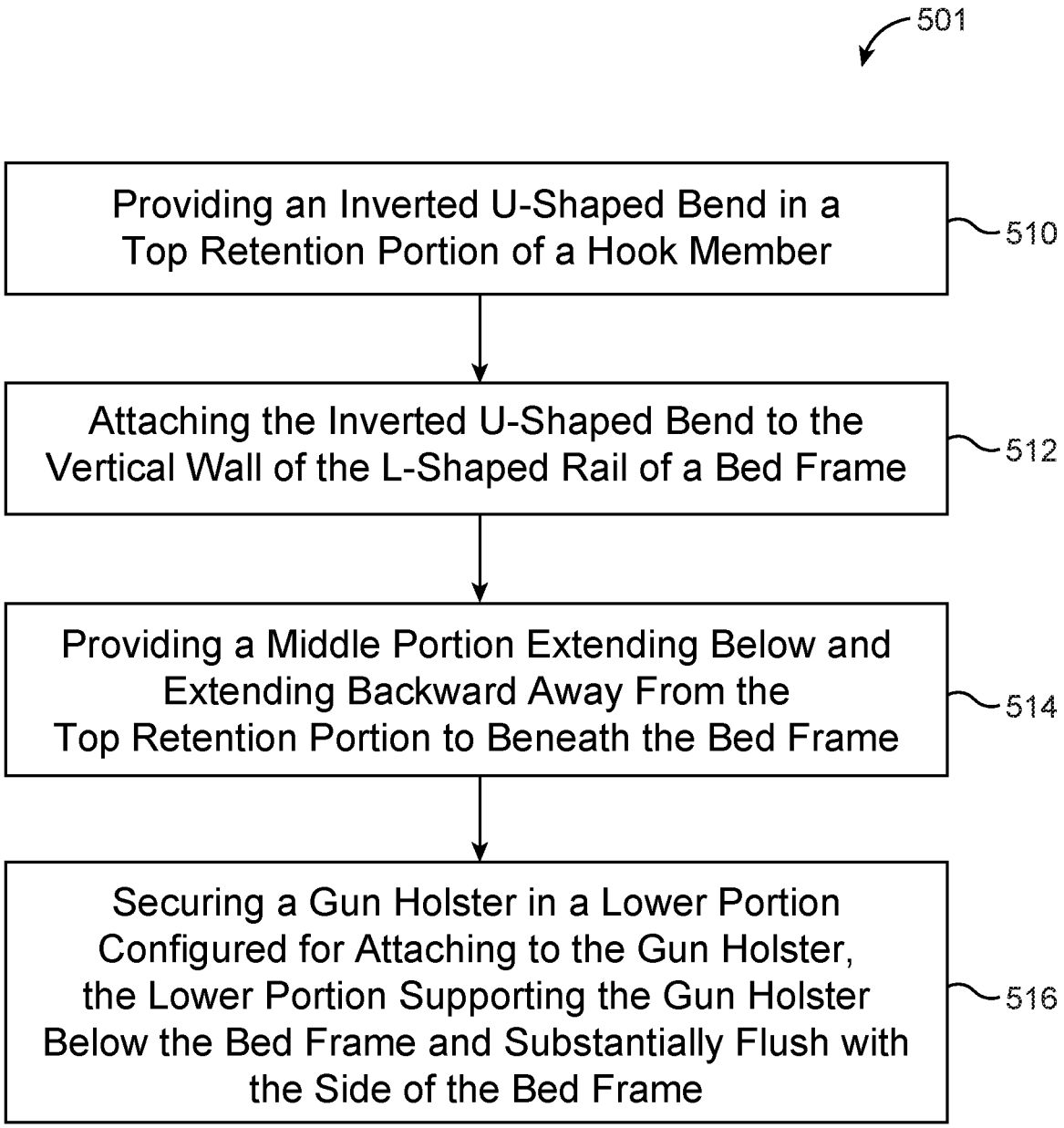
FIG. 9 is a flow chart of an exemplary process for attaching a gun holster to a gun holster holder.

FIG. 9 is a flow chart 501 of an exemplary process for attaching a gun holster 92 to a gun holster holder 101. In one or more embodiments, a method of securing a gun holster beneath a bed frame 13 with a hook member (i.e., the gun holster holder 101) that has a top retention portion 110 and a lower portion (i.e., gun holster attachment section 120) configured for attaching to a gun holster 92, the bed frame 13 formed from an L-shaped rail with a vertical wall 15 and a horizontal wall 17 begins with providing an inverted U-shaped bend 111 in the top retention portion 110 of the hook member 101 (step 510). The inverted U-shaped bend 11 in the top retention portion 110 of the hook member 101 is attached to the vertical wall 15 of the L-shaped rail of the bed frame 13 (step 512). A middle portion 113 is provided that extends below and extends backward away from the top portion 110 to beneath the bed frame 13 (step 514). A gun holster 92 is secured in the lower portion 120 configured for attaching to a gun holster 92, the lower portion 120 supports the gun holster 92 below the bed frame 13 and substantially flush with a side 16 of the bed frame 13 (step 516).

Although the invention has been discussed with reference to specific embodiments, it is apparent and should be understood that the concept can be otherwise embodied to achieve the advantages discussed. The preferred embodiments above have been described primarily as beneath bed gun holster holders. In this regard, the foregoing description of the holster holders is presented for purposes of illustration and description. It shall be apparent that various shapes and configurations of the holster holders are contemplated in one or more embodiments.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. A gun holster holder for securing a gun holster beneath a bed frame, the gun holster holder comprising:

a top portion configured to attach to a bed frame;

a vertical section emerging downward from the top portion and extending beneath the bed frame;

a horizontal section emerging perpendicular to the vertical section and extending to beneath the bed frame;

a U-shaped section emerging from the horizontal section; and, a gun holster attachment section emerging from the U-shaped section, the gun holster attachment section configured to secure a gun holster;

wherein the gun holster holder is configured to position a gun holster laterally such that a gun placed in the gun holster is underneath the bed frame and is recessed from an edge of the bed frame.

2. The gun holster holder of claim 1, wherein the top portion comprises an inverted U-shaped bend configured to couple with an L-shaped bed rail with a vertical wall and a horizontal support, the U-shaped bend configured to slip over the vertical wall of the bed rail.

3. The gun holster holder of claim 1, wherein the gun holster attachment section comprises a gun holster clip engagement section configured to receive and releasably secure a clip from the gun holster.

4. The gun holster holder of claim 3, wherein the portion of the gun holster clip engagement section proximal to the U-shaped section has a first thickness, and the portion of the gun holster clip engagement section distal from the U-shaped section has a second thickness, wherein the second thickness is greater than the first thickness.

5. The gun holster holder of claim 4, wherein the gun holster clip engagement section further comprises a sloped section transitioning between the distal and the proximal sections of the gun holster section.

6. The gun holster holder of claim 3, wherein the gun holster clip engagement section comprises a slot running perpendicular to the length of the gun holster engagement section.

7. The gun holster holder of claim 3, wherein the gun holster clip engagement section comprising a V-shaped notch formed in a mounting portion, the mounting portion having a generally constant thickness.

8. The gun holster holder of claim 3, wherein the gun holster clip engagement section comprises a mounting portion having a boss protrusion for engaging with the clip of a gun holster, forming a notch surrounded by one or more ridges configured to secure a holster clip.

9. The gun holster holder of claim 1, wherein the gun holster holder is formed in a single piece of material.

10. A method of securing a gun holster to a gun holster holder according to claim 1 beneath a bed frame with a hook member that has a top retention portion and a lower portion configured for attaching to a gun holster, the bed frame formed with an L-shaped rail with a vertical wall and a horizontal wall, the method comprising the steps of: providing an inverted U-shaped bend in the top retention portion of the hook member; attaching the inverted U-shaped bend in the top retention portion of the hook member to the vertical wall of the L-shaped rail of the bed frame; providing a middle portion extending below and extending backward away from the top portion to beneath the bed frame; and securing a gun holster in the lower portion configured for attaching to a gun holster, the lower portion supports the gun holster below the bed frame and substantially flush with a side of the bed frame.

11. A gun holster holder for securing a gun holster beneath a bed frame, the gun holster holder comprising:

a top portion configured to attach to the bed frame;

a middle section extending downward from the top portion and emerging perpendicular with respect to the top portion and extending beneath the bed frame and extending inward away from an edge of the bed frame;

a gun holster attachment section emerging from the middle section, the gun holster attachment section configured to receive and releasably secure the gun holster wherein the gun holster holder is configured to position a gun holster laterally such that a gun placed in the gun holster is underneath the bed frame and is recessed from an edge of the bed frame.

12. The gun holster holder of claim 11, wherein the top portion comprises an inverted U-shaped bend configured to couple with an L-shaped bed rail with a vertical wall and a horizontal support, the U-shaped bend configured to slip over the vertical wall of the bed rail.

13. The gun holster holder of claim 11, wherein the gun holster attachment section comprises a gun holster clip engagement section configured to receive and releasably secure a clip from the gun holster.

14. The gun holster holder of claim 13, wherein the middle section comprises a vertical section, a bend, a horizontal section, and a U-shaped section, wherein the portion of the gun holster clip engagement section proximal to the U-shaped section has a first thickness, and the portion of the gun holster clip engagement section distal from the U-shaped section has a second thickness, wherein the second thickness is greater than the first thickness.

15. The gun holster holder of claim 14, wherein the gun holster clip engagement section further comprises a sloped section transitioning between the distal and the proximal sections of the gun holster section.

16. The gun holster holder of claim 13, wherein the gun holster clip engagement section comprises a slot running perpendicular to the length of the gun holster engagement section.

17. The gun holster holder of claim 13, wherein the gun holster clip engagement section comprising a V-shaped notch formed in a mounting portion, the mounting portion having a generally constant thickness.

18. The gun holster holder of claim 13, wherein the gun holster clip engagement section comprises a mounting portion having a boss protrusion for engaging with the clip of a gun holster, forming a notch surrounded by one or more ridges configured to secure a holster clip.

* * * * *